US007487894B2

(12) United States Patent
Zahn et al.

(10) Patent No.: US 7,487,894 B2
(45) Date of Patent: Feb. 10, 2009

(54) DISPENSING CONTAINER HAVING CONTOURED DISPENSING HEAD

(75) Inventors: Walter Zahn, Columbia, SC (US); Shawn W. Miller, Columbia, SC (US); David Rocheleau, Lexington, SC (US); Mohammad R. Sadeghi, Columbia, SC (US); Bernd Hansen, Laufen (DE)

(73) Assignee: Holopack International Corp., Columbia, SC (US)

( * ) Notice: Subject to any disclaimer, the term of this patent is extended or adjusted under 35 U.S.C. 154(b) by 105 days.

(21) Appl. No.: 11/286,244

(22) Filed: Nov. 23, 2005

(65) Prior Publication Data

US 2006/0108385 A1 May 25, 2006

Related U.S. Application Data

(63) Continuation-in-part of application No. 10/996,973, filed on Nov. 24, 2004.

(51) Int. Cl.
*B65D 47/10* (2006.01)

(52) U.S. Cl. ..... 222/541.9; 222/541.5; 222/212; 222/107; D24/115; 604/212

(58) Field of Classification Search ..... 222/212, 222/107, 541.6, 541.9, 541.5; D24/115; 30/326; 604/212
See application file for complete search history.

(56) References Cited

U.S. PATENT DOCUMENTS 201,369 A 3/1878 Walker ..... 30/123
442,696 A 12/1890 Thompson ..... 222/416
D24,197 S 4/1895 Nye ..... D7/653
D24,528 S 8/1895 Tilton ..... D7/653
D34,314 S 4/1901 Day ..... D7/653

(Continued)

FOREIGN PATENT DOCUMENTS

CH 676 109 A 12/1990

(Continued)

OTHER PUBLICATIONS

UK Patent Application GB 2 083 341 A, published Mar. 24, 1982, Tsai, entitled "Article of table cutlery".

(Continued)

*Primary Examiner*—Patrick F Brinson
(74) *Attorney, Agent, or Firm*—Nelson Mullins Riley & Scarborough, LLP

(57) ABSTRACT

A dispensing container fillable with a liquid includes a squeezable reservoir for holding the liquid prior to dispensing; a dispensing head which appears substantially flat in profile and which is integral with the squeezable reservoir and having a distal end and a proximal end and having a bottom surface and a top surface one or both of which has an indented portion; an outlet at the distal end of the dispensing head for dispensing the liquid from the container; a passage interconnecting the squeezable reservoir and the outlet; and a stop disposed near the proximal end of the dispensing head to prevent over-insertion of the dispensing head into a user's mouth when the container is used to dispense the liquid to the user. Containers that are pre-filled with liquid and a method of making the containers are also described.

21 Claims, 10 Drawing Sheets

U.S. PATENT DOCUMENTS

| | | | | | |
|---|---|---|---|---|---|
| 878,524 | A | | 2/1908 | Gregory et al. | 30/123.3 |
| D43,936 | S | | 4/1913 | Nerney | D7/653 |
| D52,688 | S | | 11/1918 | Westbrook | D7/653 |
| 1,661,595 | A | | 3/1928 | Bowen | 99/532 |
| 2,041,351 | A | | 5/1936 | Jones | 221/60 |
| 2,180,063 | A | | 11/1939 | McKinley | 604/33 |
| 2,252,119 | A | * | 8/1941 | Edmonds | 30/123.3 |
| 2,293,922 | A | | 8/1942 | Serins | 221/148 |
| 2,688,243 | A | | 9/1954 | Bowen | 68/213 |
| RE24,251 | E | | 12/1956 | Kaplan et al. | 222/107 |
| 2,777,612 | A | | 1/1957 | Bensen | 222/209 |
| 2,795,043 | A | | 6/1957 | Fleischer | 30/123 |
| 2,953,170 | A | | 9/1960 | Bush | 141/18 |
| 3,045,879 | A | | 7/1962 | Daly | 222/482 |
| 3,090,071 | A | | 5/1963 | Brooy | 15/595 |
| 3,104,032 | A | | 9/1963 | Hansen | 222/91 |
| 3,116,152 | A | | 12/1963 | Smith | 99/171 |
| 3,133,679 | A | | 5/1964 | Brown | 222/205 |
| 3,184,121 | A | | 5/1965 | Volckening | 222/213 |
| 3,306,500 | A | | 2/1967 | Williams | 222/209 |
| 3,356,244 | A | | 12/1967 | Witchell | 215/32 |
| 3,381,857 | A | | 5/1968 | Francis | 222/100 |
| 3,410,457 | A | | 11/1968 | Brown | 222/191 |
| 3,473,221 | A | | 10/1969 | Flanders | 30/141 |
| 3,833,154 | A | | 9/1974 | Markowitz | 222/212 |
| 3,913,734 | A | * | 10/1975 | Siegel | 206/470 |
| 3,946,652 | A | | 3/1976 | Gorin | 99/323 |
| 3,993,223 | A | | 11/1976 | Welker, III et al. | 222/107 |
| 3,995,772 | A | | 12/1976 | Liautaud | |
| 4,020,978 | A | | 5/1977 | Szczepanski | 222/209 |
| 4,087,002 | A | | 5/1978 | Bambara et al. | 206/523 |
| D249,958 | S | * | 10/1978 | Meierhoefer | D24/117 |
| 4,133,457 | A | | 1/1979 | Klassen | 222/212 |
| 4,182,002 | A | | 1/1980 | Holec | 17/30 |
| 4,192,360 | A | | 3/1980 | Rodriquez | 141/24 |
| 4,207,990 | A | | 6/1980 | Weiler et al. | 220/267 |
| D257,821 | S | | 1/1981 | Pike | D7/141 |
| 4,248,227 | A | | 2/1981 | Thomas | 128/232 |
| D260,178 | S | * | 8/1981 | Pagels | D24/117 |
| 4,298,045 | A | | 11/1981 | Weiler et al. | 150/5 |
| 4,411,656 | A | | 10/1983 | Cornett, III | 604/212 |
| 4,413,753 | A | | 11/1983 | Stock | 222/149 |
| 4,469,250 | A | | 9/1984 | Evezich | 222/83.5 |
| 4,502,616 | A | * | 3/1985 | Meierhoefer | 222/215 |
| D282,348 | S | | 1/1986 | Federighi | D9/341 |
| 4,562,942 | A | | 1/1986 | Diamond | 222/386.5 |
| 4,592,493 | A | | 6/1986 | Smith | 222/212 |
| 4,637,934 | A | | 1/1987 | White | 426/117 |
| 4,657,151 | A | | 4/1987 | Cabernoch | 215/11 E |
| D296,869 | S | * | 7/1988 | Bauwens | D9/696 |
| 4,760,937 | A | | 8/1988 | Evezich | 222/95 |
| 4,787,536 | A | | 11/1988 | Widerstrom | 222/212 |
| 4,830,222 | A | | 5/1989 | Read | 222/106 |
| 4,841,637 | A | | 6/1989 | Scholzen | 30/125 |
| 4,842,165 | A | | 6/1989 | Van Coney | 222/95 |
| 4,880,409 | A | | 11/1989 | Winbad et al. | 604/73 |
| 4,888,188 | A | | 12/1989 | Castner, Sr. et al. | 426/109 |
| 4,890,744 | A | | 1/1990 | Lane, Jr. et al. | 206/632 |
| 4,966,312 | A | | 10/1990 | Waring | 222/209 |
| D312,209 | S | * | 11/1990 | Morrow et al. | D24/117 |
| 4,993,568 | A | | 2/1991 | Morifuji et al. | 215/11.1 |
| 5,035,689 | A | | 7/1991 | Schroeder | 604/234 |
| 5,038,476 | A | | 8/1991 | McCrea | 30/141 |
| 5,038,974 | A | | 8/1991 | DaCosta | 222/106 |
| 5,062,550 | A | | 11/1991 | Singh | 222/80 |
| 5,088,849 | A | | 2/1992 | Johnson et al. | 401/44 |
| 5,101,991 | A | | 4/1992 | Morifuji et al. | 215/11.1 |
| 5,154,318 | A | | 10/1992 | Lampard | 222/105 |
| 5,158,192 | A | | 10/1992 | Lataix | 215/32 |
| 5,238,157 | A | | 8/1993 | Gentile | 222/541 |
| 5,409,125 | A | | 4/1995 | Kimber et al. | 215/32 |
| D368,209 | S | | 3/1996 | Decker | D7/653 |
| 5,556,008 | A | | 9/1996 | Silver et al. | 222/192 |
| 5,664,705 | A | | 9/1997 | Stolper | 222/212 |
| 5,667,084 | A | | 9/1997 | Duggal et al. | 215/11.4 |
| D392,184 | S | | 3/1998 | Weiler | D9/392 |
| 5,817,082 | A | | 10/1998 | Niedospial, Jr. et al. | 604/414 |
| 5,897,009 | A | | 4/1999 | O'Meara | 215/48 |
| 5,902,298 | A | | 5/1999 | Niedospial, Jr. et al. | 604/414 |
| 5,908,124 | A | | 6/1999 | Klauke et al. | 215/48 |
| 5,975,305 | A | | 11/1999 | Barger | 206/572 |
| D417,848 | S | * | 12/1999 | Marshall | D9/503 |
| 6,113,008 | A | | 9/2000 | Arsenault et al. | 239/337 |
| 6,173,852 | B1 | | 1/2001 | Browne | 215/247 |
| 6,241,124 | B1 | | 6/2001 | Hoyt | 222/143 |
| 6,264,074 | B1 | | 7/2001 | Emilsson | 222/527 |
| 6,283,320 | B1 | | 9/2001 | Patch | 220/88.1 |
| 6,347,727 | B1 | | 2/2002 | Diaz | 222/101 |
| 6,357,450 | B1 | | 3/2002 | Paice | 132/114 |
| 6,357,626 | B1 | | 3/2002 | Zhang et al. | 222/78 |
| D456,507 | S | * | 4/2002 | LeMarr et al. | D24/115 |
| D458,366 | S | * | 6/2002 | Hellberg et al. | D24/115 |
| 6,457,612 | B1 | | 10/2002 | Zhang et al. | 222/465.1 |
| D471,628 | S | * | 3/2003 | Louviere | D24/115 |
| 6,626,308 | B2 | | 9/2003 | Weiler | 215/48 |
| 6,651,845 | B1 | | 11/2003 | Schroeder | 222/83 |
| D492,406 | S | | 6/2004 | Masuda et al. | D24/115 |
| D492,407 | S | | 6/2004 | Masuda et al. | D24/115 |
| D496,833 | S | | 10/2004 | Lantz | D7/653 |
| 7,028,862 | B2 | | 4/2006 | Poynter | 222/23 |
| 7,032,590 | B2 | * | 4/2006 | Loeffler et al. | 128/200.24 |

FOREIGN PATENT DOCUMENTS

| | | | |
|---|---|---|---|
| DE | 197 12 334 | A | 10/1998 |
| GB | 1 444 848 | A | 8/1976 |
| GB | 2 006 712 | A | 5/1979 |
| GB | 2 120 630 | A | 12/1983 |
| WO | WO 01/94213 | A2 | 12/2001 |
| WO | WO 01/94213 | A3 | 12/2001 |

OTHER PUBLICATIONS

Patent Cooperation Treaty, ISA/US, PCT International Search Report and Written Opinion, completion date Apr. 14, 2006, mailing date May 11, 2006, PCT/US05/42576.

Patent Cooperation Treaty. ISA/US, PCT International Search Report and Written Opinion, completion date May 29, 2006, mailing date Aug. 22, 2006, PCT/US05/42575.

European Patent Office, Extended European Search Report, completed Aug. 21, 2008, mailed Aug. 29, 2008, European Patent Application No. 05852109.7.

Abstract of CH 676 109 A.

Abstract of DE 197 12 334 A.

* cited by examiner

DISPENSING CONTAINER HAVING CONTOURED DISPENSING HEAD

CROSS-REFERENCE TO RELATED APPLICATIONS

This application is a continuation-in-part of U.S. patent application Ser. No. 10/996,973, filed Nov. 24, 2004, and titled DISPENSING CONTAINER, which is incorporated by reference herein in its entirety.

BACKGROUND OF THE INVENTION (1) Field of the Invention

The present invention relates to a container for dispensing a liquid, and more particularly to a single-use container for dispensing a measured amount of a liquid.

(2) Description of the Related Art

It has long been recognized that the requirements for administering liquids in accurate amounts, such as is required for medicines, drugs, vitamins, and the like, are different than for the consumption of foods. This is particularly true where the subject is a child or infant. In the case of medicines, the amount of the liquid must be carefully controlled, and care must be taken to insure that the entire dose is successfully administered. When the subject is an infant, consumption may not be voluntary, and spillage is a danger. Moreover, when an infant is to receive the liquid, great care must be taken to avoid over-insertion of a dosing device into the mouth and throat, thereby causing choking.

In response to these requirements, various devices have been described that are designed to address one or more of the particular requirements. For example, dispensing devices having open, spoon-like bowls in which a liquid is offered are described in U.S. Pat. Nos. 2,795,043, 4,888,188, 6,264,074, 5,154,318, 5,975,305, 4,841,637, 3,133,679, 3,473,221, 4,192,360, 4,830,222, 6,347,727, 3,946,652, D496,833, U.S. Pat. No. 3,116,152, among others. Such devices, however, in most cases, require the subject receiving the contents to voluntarily accept and remove the contents of the bowl when presented.

Spoons that provide for dispensing a liquid at or near the distal end of the bowl are described in U.S. Pat. Nos. 2,688,243, 5,038,974, 5,038,476, 201,369, D34,314, D52,688, D24,197 and D368,209. Many of these devices appear to depend upon either gravity, or an action by the recipient, to deliver the contents of the device.

Feeding devices or injecting devices having multiple parts, and which are designed for refilling and reuse, are described in U.S. Pat. Nos. 4,880,409, 5,556,008, 878,524, 1,661,595, 3,090,071, 3,410,457, 4,182,002, 5,062,550, among others.

Other pre-filled disposable containers are described in U.S. Pat. No. 6,357,626.

Yet, with the advances of the prior art, several problems remain to be overcome. For example, it would be useful to provide a dispensing container that did not have multiple parts and that could be made simply and inexpensively. It would also be useful if such dispensing container could be disposed after a single use. It would be useful if such a container could be designed to avoid requiring the user or another person to fill the container and/or measure the amount of liquid to be dosed, thereby improving accuracy, avoiding mistakes, and reducing waste. It would additionally be useful if such a container protected the integrity of the contents during packaging, transporting, selling and storage. Furthermore, it would be useful if such dispensing container could be safely used with infants, in particular avoiding over-insertion of the container into the mouth of the infant and thereby protecting against choking.

SUMMARY OF THE INVENTION

Briefly, therefore the present invention is directed to a novel dispensing container fillable with a liquid, the container comprising: a squeezable reservoir for holding the liquid prior to dispensing; a substantially flat dispensing head which is integral with the squeezable reservoir and having a distal end and a proximal end; an outlet at the distal end of the dispensing head for dispensing the liquid from the container; a passage interconnecting the squeezable reservoir and the outlet; and a stop disposed near the proximal end of the dispensing head to prevent over-insertion of the dispensing head into a user's mouth when the container is used to dispense the liquid to the user.

The present invention is also directed to a novel pre-filled dispensing container having a liquid therein, the container comprising: a squeezable reservoir containing the liquid; a substantially flat dispensing head which is integral with the squeezable reservoir and having a distal end and a proximal end; an outlet at the distal end of the dispensing head for dispensing the liquid from the container; a passage interconnecting the squeezable reservoir and the outlet; and a stop disposed near the proximal end of the dispensing head to prevent over-insertion of the dispensing head into a user's mouth when the container is used to dispense liquid to the user.

The present invention is also directed to a novel method of making a pre-filled dispensing container having a liquid therein, the method comprising: extruding a polymer into a blow mold; closing the mold; forming a dispensing container comprising a squeezable reservoir designed to contain the liquid, a substantially flat dispensing head which is integral with the squeezable reservoir and having a distal end and a proximal end, an outlet at the distal end of the dispensing head for dispensing liquid from the container, a passage interconnecting the squeezable reservoir and the outlet, and a stop disposed near the proximal end of the dispensing head to prevent over-insertion of the dispensing head into a user's mouth when the container is used to dispense liquid to the user; adding the liquid to the dispensing container; sealing the container; and removing the sealed pre-filled dispensing container from the mold.

Among the several advantages found to be achieved by the present invention, therefore, may be noted the provision of a dispensing container that can be unitary and which does not require multiple parts, and which can be made simply and inexpensively, the provision of a dispensing container that can be disposable after a single use, the provision of a dispensing container that avoids the requirement of filling the container and/or measuring the amount of liquid to be dosed, thereby improving accuracy, avoiding mistakes, and reducing waste, the provision of a dispensing container that protects the integrity of the contents during packaging, transporting, selling and storage, and the provision of a dispensing container that can be safely used with infants, in particular a container that avoids over-insertion into the mouth of the infant and thereby protects against choking.

BRIEF DESCRIPTION OF THE DRAWINGS

FIG. 1 illustrates an embodiment of the present dispensing container, where

FIG. 2 illustrates an embodiment of the present pre-filled dispensing container, where

FIG. 3 is an illustration of an embodiment of the present dispensing container showing a perspective view of the device and illustrating the breakable seal, where

FIG. 4 illustrates an embodiment of the present dispensing container, where

FIG. 5 illustrates an embodiment of the present pre-filled dispensing container, where

FIG. 6 is an illustration of an embodiment of the present dispensing container showing a perspective view of the device and illustrating the breakable seal, where

FIG. 8 illustrates an embodiment of the present dispensing container having a single flow channel, where

Corresponding reference characters indicate corresponding parts throughout the several views of the drawings. The description of elements of the device with reference to one or more specific figures is not an indication that those same elements do not also appear in other figures.

DETAILED DESCRIPTION OF THE PREFERRED EMBODIMENTS

Figure 1A:
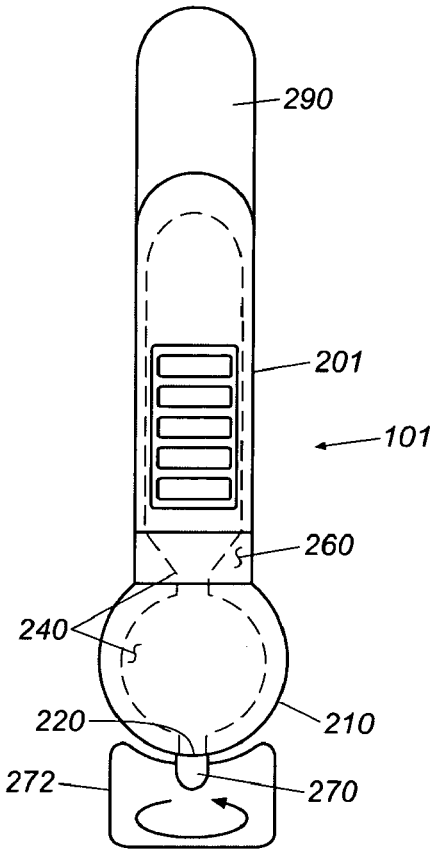
FIG. 1A shows the top view.
Figure 1B:
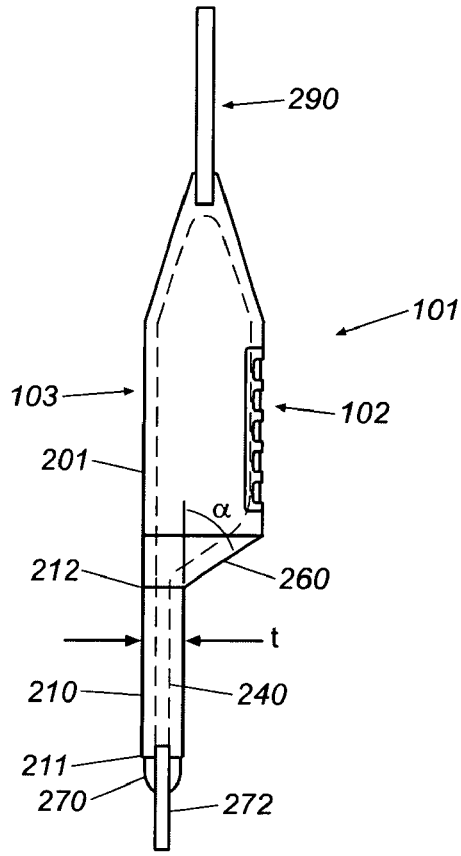
FIG. 1B shows a side view.

In accordance with the present invention, it has been discovered that a novel dispensing container can be produced that has several advantages over earlier dispensing containers. The present dispensing container is fillable with a liquid to be dispensed to a user.

As used herein, the term "user" means a subject who receives the liquid contained in the device. In other words, the user is the subject to whom the liquid of the device is administered. The contents can be administered by the user or by another. For example, the device can be operated by an adult to administer medicine to a user, who could be a child.

The present container includes a squeezable reservoir for holding the liquid prior to dispensing and a substantially flat dispensing head which is integral with the squeezable reservoir and which has an outlet at its distal end for dispensing the liquid from the container. A passage interconnecting the squeezable reservoir and the outlet leads the liquid to the outlet, and a stop disposed near the proximal end of the dispensing head prevents over-insertion of the dispensing head into a user's mouth when the container is used to dispense the liquid contents.

The scope of the present invention is intended to include dispensing containers that are fillable with a liquid, and also those that have liquid contents added. Also included is a method of producing the novel container.

The present dispensing container can be described with reference to the several figures that accompany this specification. As shown in FIG. 1A-FIG. 1C, and FIG. 4A-4C, the dispensing container [101] comprises a squeezable reservoir [201] for holding a liquid prior to dispensing; a substantially flat dispensing head [210] which is integral with the squeezable reservoir and having a distal end [211] and a proximal end [212]; an outlet [220] at the distal end of the dispensing head for dispensing the liquid from the container; a passage [240] interconnecting the squeezable reservoir [201] and the outlet [220]; and a stop [260] disposed near the proximal end [212] of the dispensing head [210] to prevent over-insertion of the dispensing head into a user's mouth when the container is used to dispense the liquid to the user.

In a preferred embodiment, the present dispensing container [101] is unitary. In other words, all parts of the dispensing container are integral with each other. In fact, as will be discussed in detail below, all parts of the container are preferably formed at substantially the same time from a single piece of material with all parts integral and continuous.

After the liquid contents of the container have been added to the squeezable reservoir [201], it is desirable that the outlet [220] is closed by a breakable seal [270] which reveals the outlet [220] when the seal is broken. The breakable seal [270] is preferably formed as an integral part of the dispensing head [210] at the same time as, or immediately after, the dispensing head itself is formed. In order to facilitate the easy removal of the breakable seal [270], it is preferred that the breakable seal is integral with a tab [272] which is designed for gripping between the thumb and forefinger for the purpose of breaking the seal. In one embodiment, for example, the user, or person administering the liquid, could break the seal by gripping the tab between thumb and forefinger, and applying a twisting motion. Breakage of the breakable seal [270] reveals the outlet [220] and permits the liquid [301], as shown in FIG. 2A, FIG. 2B, FIG. 5A, and FIG. 5B to exit the dispensing container [101] at the outlet [220].

Figure 3A:
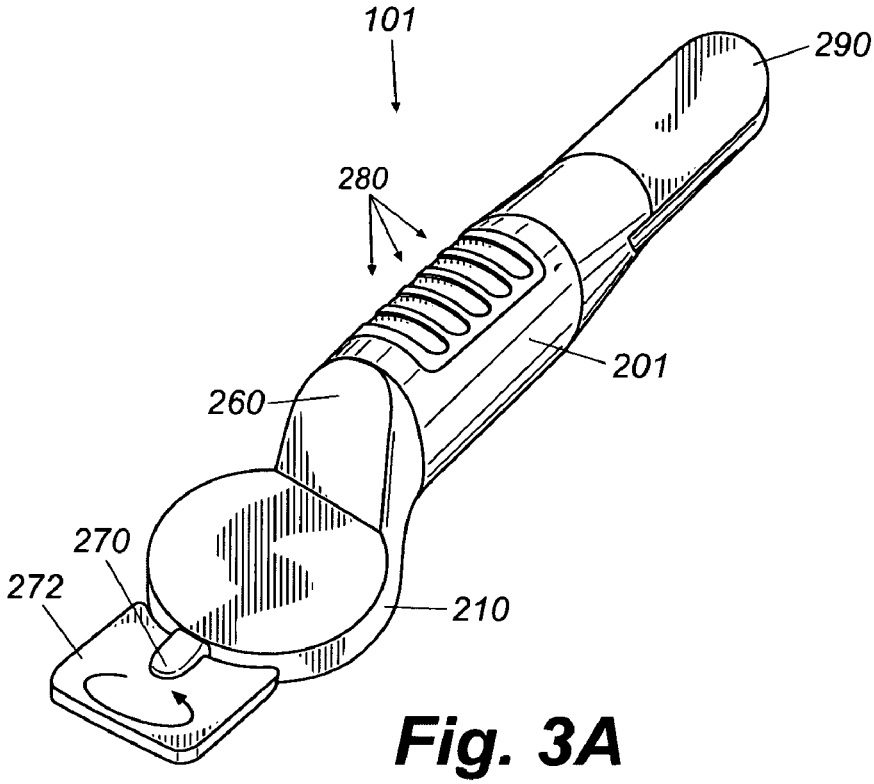
FIG. 3A shows the seal and tab in place prior to removal.

The tab [272] that is integral with the breakable seal [270] can have any shape that is suitable for its function. However, it is preferred that the shape of the tab conform to, or complement, the shape of the distal end [211] of the dispensing head [210]. For example, if the distal end of the dispensing head is rounded, then it is preferred that the surface of the tab [272] nearest the dispensing head also be similarly rounded. This feature can be seen, for example, in FIG. 1A and FIG. 4A. If desirable, the tab [272] can also be imprinted with instructions or signals that indicate how to break the seal and reveal the outlet. One such signal is an arrow signal indicating a twisting action, as illustrated, for example, in FIG. 3A and FIG. 6A.

Figure 1C:
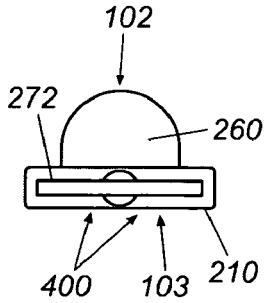
FIG. 1C shows a view from the end having the breakable seal.
Figure 4A:
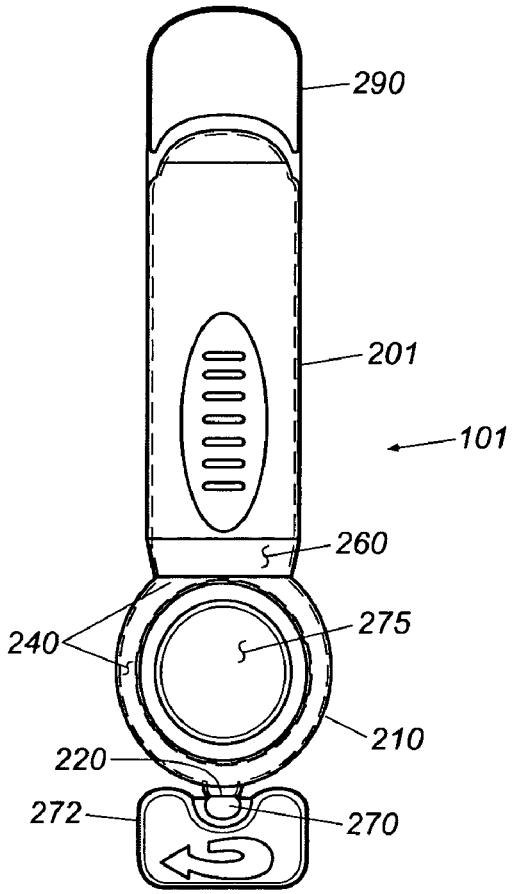
FIG. 4A shows the top view.
Figure 4B:
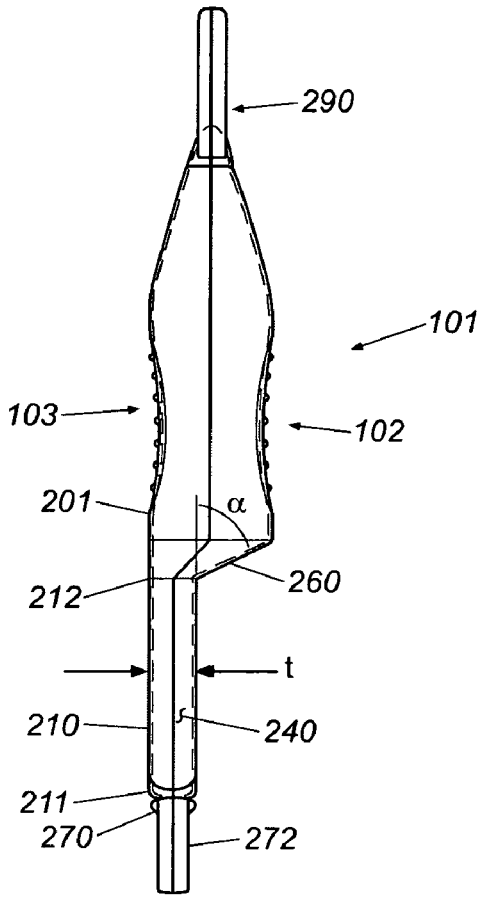
FIG. 4B shows a side view.
Figure 4C:
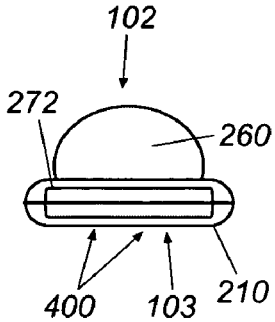
FIG. 4C shows a view from the end having the breakable seal.
Figure 5A:
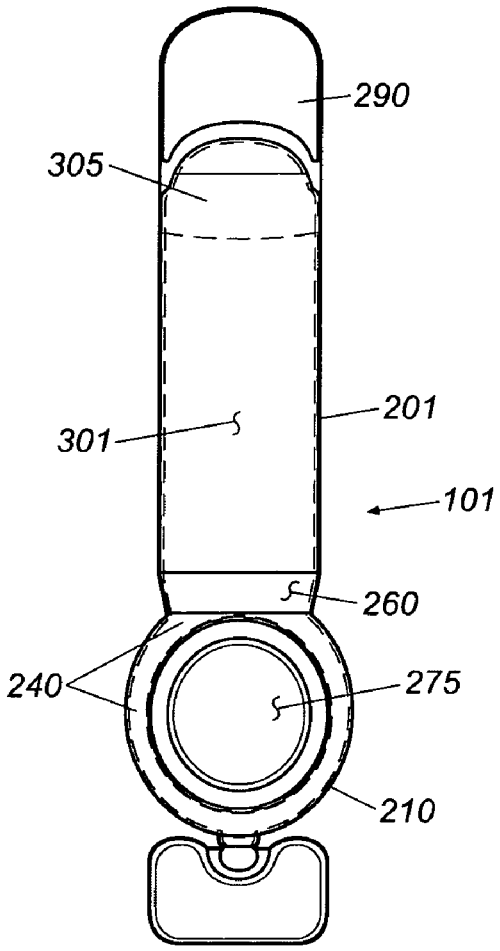
FIG. 5A shows the top view (without the optional traction aid) and FIG. 5B shows a side view, with both views illustrating liquid in the reservoir and a head-space.
Figure 5B:
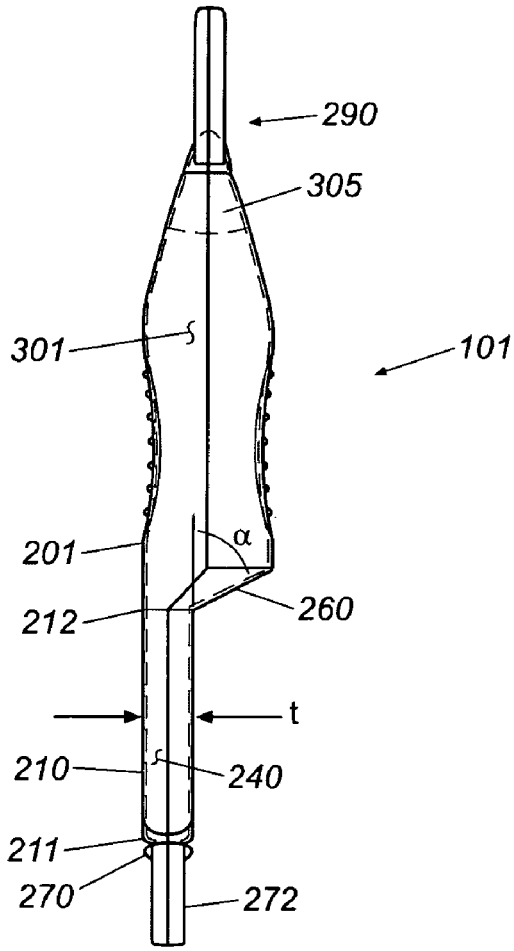

It is preferred that the present dispensing container [101] has a top [102] and a bottom [103] and wherein at least a portion of the bottom is flat, thereby permitting the container to rest stably on a flat surface. This feature, which is indicated as [400] in FIG. 1C, and FIG. 4C, provides that the container can be laid down on a table, or other flat surface, without rolling or tilting. An advantage of this feature is that, if the breakable seal [270] has been broken, the container remains stable and can retain the liquid in the reservoir [201] without spilling.

The squeezable reservoir [201] is a part of the container that is designed to contain some amount of a liquid [301]. In that embodiment of the invention where the reservoir has been pre-filled with the liquid, the squeezable reservoir [201] contains the liquid [301]. The reservoir [201] can be designed to have a volume sufficient to accommodate any amount of the liquid [301] that is desirable. It is preferable that the reservoir is designed to have a volume that is only slightly larger than the amount of the liquid that will be added. In order to simplify the loading of standard dosages of certain liquids, the reservoir can be made to hold a standard volume of liquid. For example, the squeezable reservoir [201] can have a capacity of about 1 ml of the liquid, or 2 ml, 5 ml, 10 ml, 15 ml, 25 ml, or any other volume of the liquid that is desired. An advantage of this feature is that an accurate amount of a liquid can be pre-filled into the container without any action by the user. This reduces the chance of error in measurement and in dosage administration.

As used herein to describe the reservoir, the term "squeezable" is understood to mean that the reservoir can be deformed or crushed with a resulting reduction in volume by squeezing between the thumb and finger(s) of one hand.

Figure 3B:
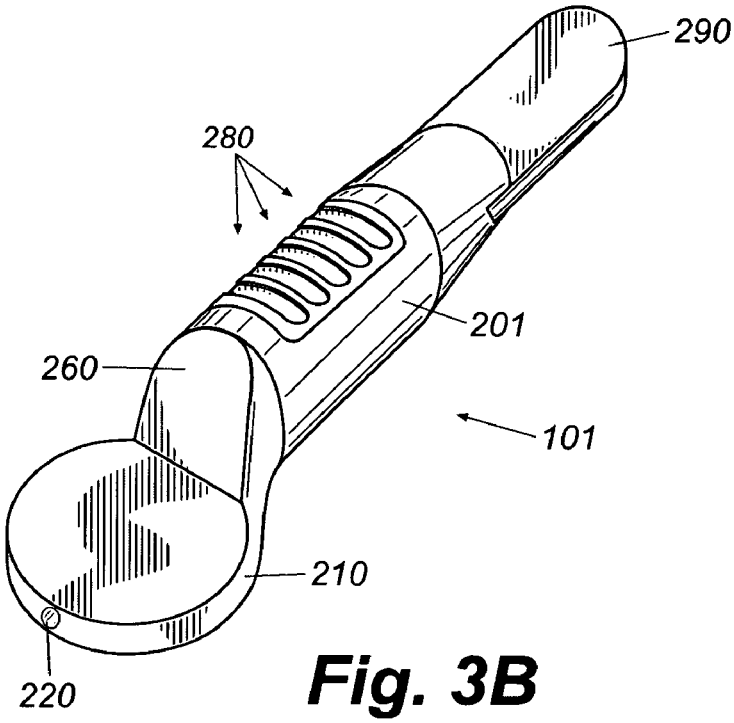
FIG. 3B shows the outlet of the device after breaking and removing the breakable seal.
Figure 6A:
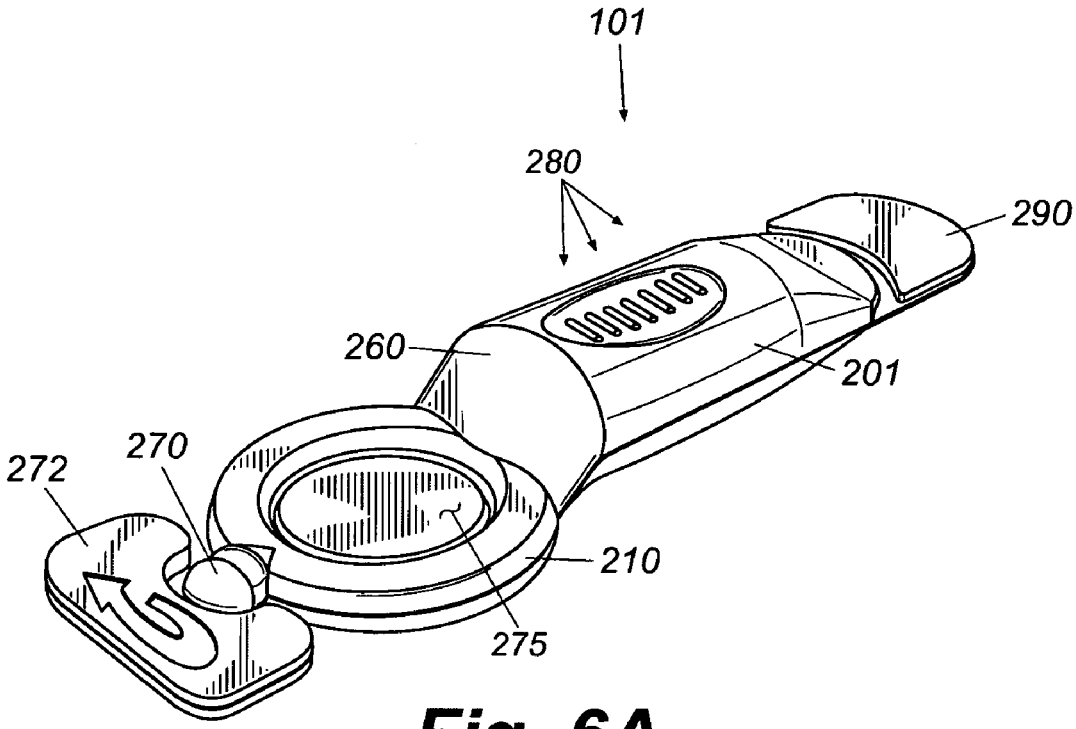
FIG. 6A shows the seal and tab in place prior to removal.
Figure 6B:
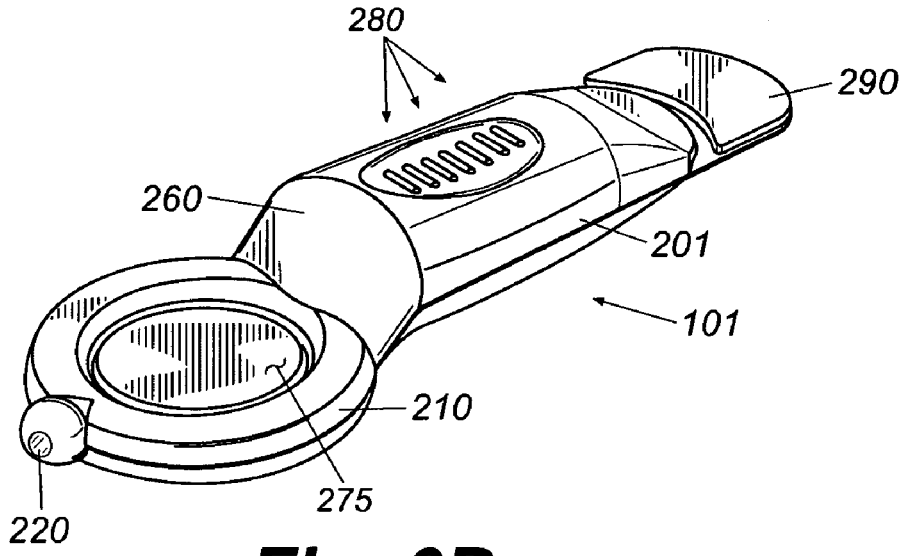
FIG. 6B shows the outlet of the device after breaking and removing the breakable seal.
Figure 7A:
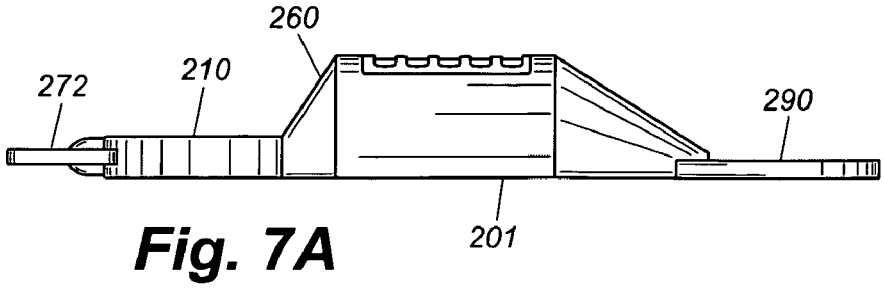
FIG. 7, in FIG. 7A, FIG. 7B, FIG. 7C, FIG. 7D, and FIG. 7E, illustrates the side views of several different configurations of the present dispensing container and illustrates, without limitation, several embodiments that are within the scope of the invention.
Figure 7B:
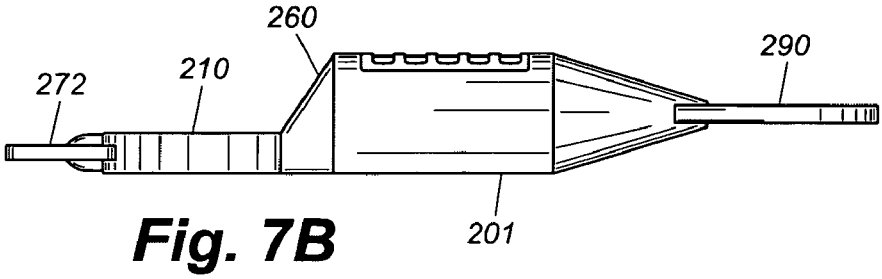
Figure 7C:
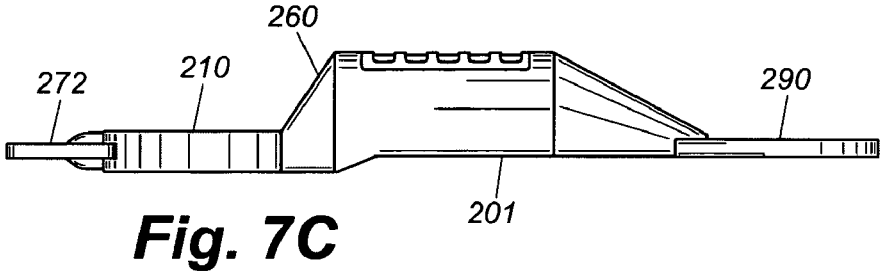
Figure 7D:
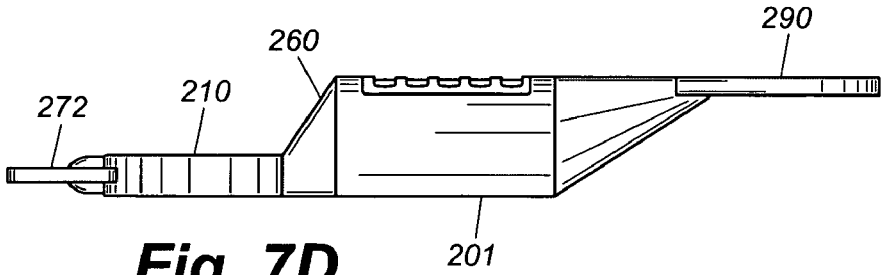
Figure 7E:
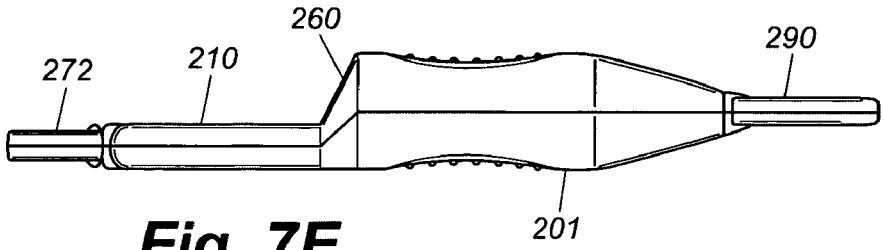

In order to improve the gripping characteristics of the dispensing container [101], the squeezable reservoir [201] can have an outer surface having a traction aid thereon [280], whereby the traction aid improves the grip of the container by the user, or the person administering the liquid, if different from the user. The traction aid [280] comprises at least one of ribs, grooves, a roughened area, or a checkered area, or the like. An example of this feature can be seen in FIG. 3A, FIG. 3B, where a section of the outer surface of the top of the squeezable reservoir is shown to have grooves or ridges as a traction aid [280] for gripping the device. The grooves and/or ridges can be substantially straight and perpendicular to the longitudinal axis of the container, or they can be curved, angled, or of any other shape. In FIG. 6A and FIG. 6B, an embodiment of the traction aid [280] is present on the top and bottom surfaces of the device, and is shaped in an oval configuration with crosswise molded grooves and ridges. The present traction aid can be placed on the dispensing container at any location where improved gripping is desirable. For example, this can be on the top, bottom, top and bottom, and/or the sides of the dispensing container.

The traction aid can be can be added to the dispensing container [101] at any time. For example, it may be molded into the device during manufacture, or it may be machined into the surface of the device any time after manufacture. It is preferable, however, that the traction aid be molded integrally into the surface of the device at the time of manufacturing.

One part of the dispensing container [101] is the substantially flat dispensing head [210] that is integral with the squeezable reservoir [201], and which has a distal end [211] and a proximal end [212]. Typically an outlet [220] is located at the distal end [211] of the dispensing head [210] for dispensing the liquid [301] from the container. The proximal end [212] of the dispensing head [210] abuts the squeezable reservoir [201].

The distal end of the dispensing head [210] can be connected to the reservoir [201] at any location relative to the longitudinal axis of the device [101]. While it has been shown to be preferred that the dispensing head [210] is located at an offset to the longitudinal axis, namely, close to or at the bottom of the device, as is illustrated in the present figures, it could also be located as centered along the longitudinal axis, or near the top of the device, or at any other location relative to the longitudinal axis.

While the dispensing head [210] is described as being substantially flat, it should be understood that the head optionally has some slight degree of curvature and/or rounded edges, as would be introduced during manufacture, or for the purpose of comfortable and safe use. Also, the dispensing head can have certain contours or indentations [275] that are molded into the head [210] during fabrication, such as are shown in FIGS. 4A, 5A, 6A, 6B, 8A, 8B, and 8D, for example. It is preferred, however, that the overall aspect of the dispensing head, when viewed from the side, as shown for example in FIG. 1B, FIG. 2B, FIG. 4B, FIG. 5B, and FIG. 8C, is that it has a substantially flat profile. In other words, the dispensing head [210] is without the concave profile of a spoon. In certain embodiments, one or both of the top and bottom surfaces of the dispensing head [210] are substantially flat.

In preferred embodiments, as illustrated in FIGS. 4A, 5A, 6A, 6B, 8A, 8B, and 8F, either or both of the top surface of the dispensing head and the bottom surface has an indented portion [275]. When the terms "indented portion" are used herein, they refer to portions of the top surface and/or the bottom surface of the dispensing head that are depressed, or indented, below the plane of the surface as it would appear in profile. For example, an indented portion can be formed in either surface of the dispensing head by a mold projection as the device is formed in a blow-molding operation. The top and the bottom of the dispensing head can have more than one indented portion, and in fact, can have an unlimited number of indented portions.

When the present device is formed by the operation of blow-molding, it is possible to design the mold so that indentations that are formed in the dispensing head are substantially matching. In other words, indentations in the top are of a shape and alignment that substantially match indentations in the bottom, and portions of the top can be sealed to matching portions of the bottom during the blow molding process, thereby forming desired channels and/or shapes in the dispensing head.

Figure 8A:
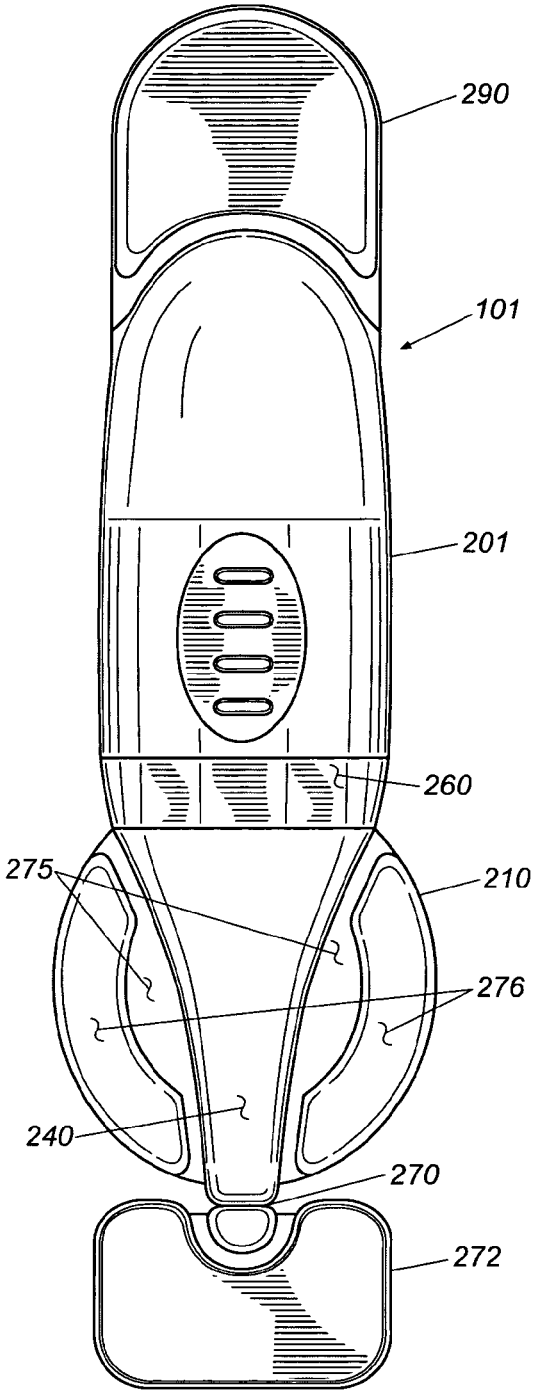
FIG. 8A shows the top view.
Figure 8B:
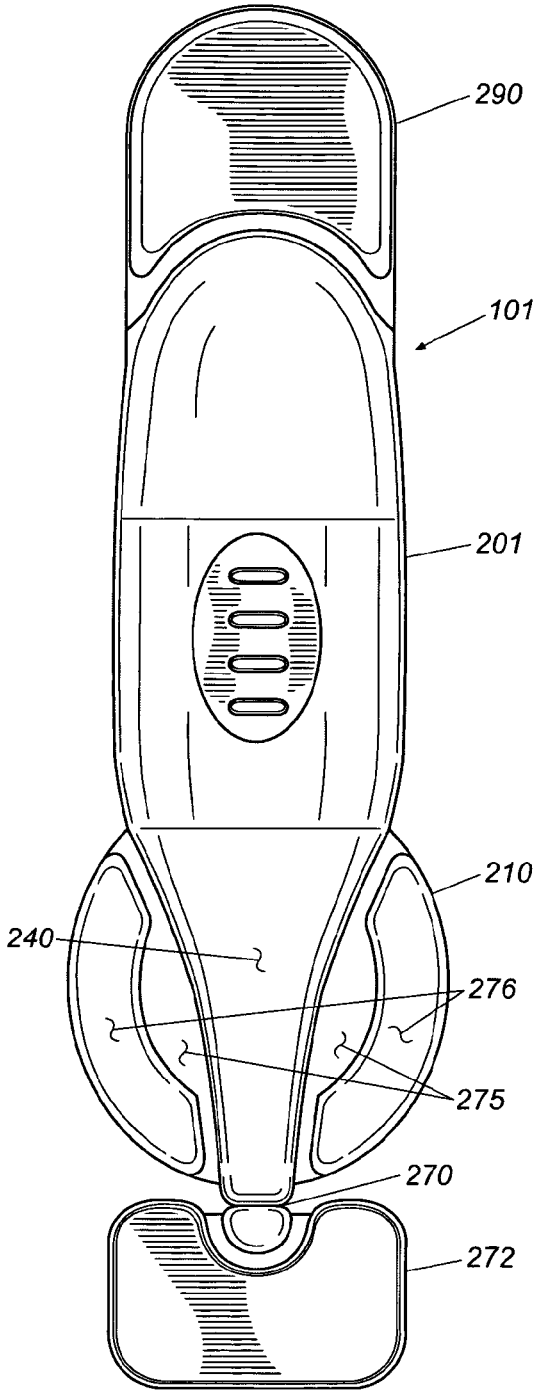
FIG. 8B shows the bottom view.
Figure 8C:
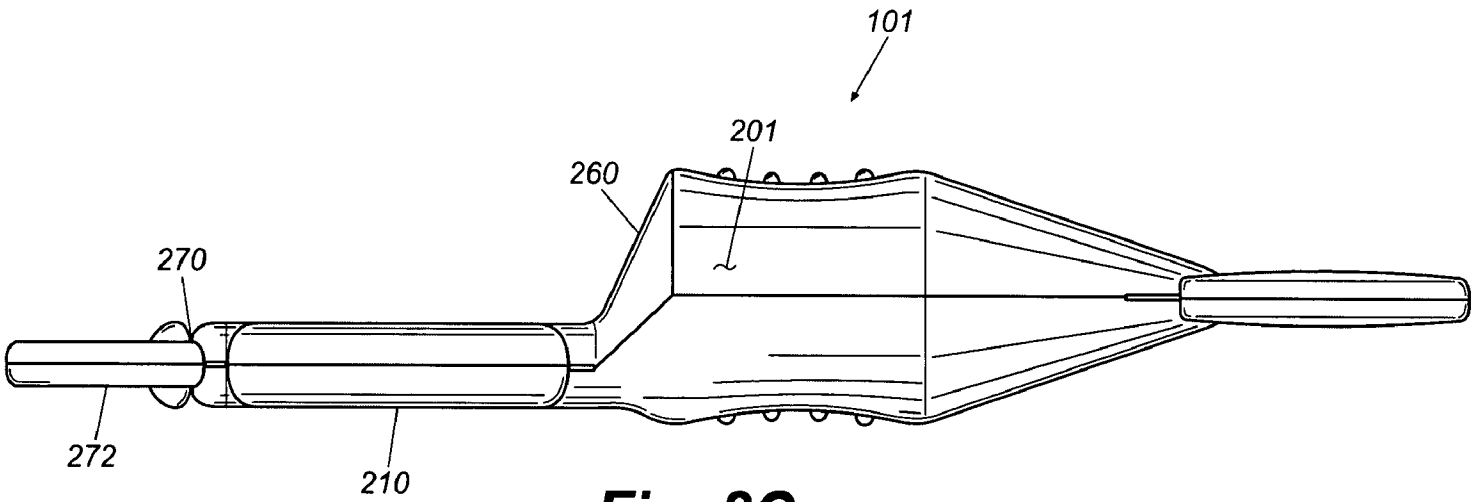
FIG. 8C shows the right side view (the left side view is a mirror image of this view)
Figure 8E:
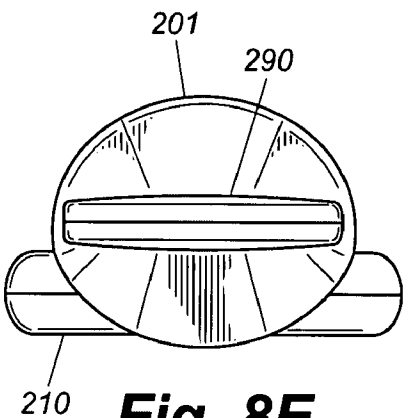
FIG. 8E shows the view from the end having the tail (the back)
Figure 8D:
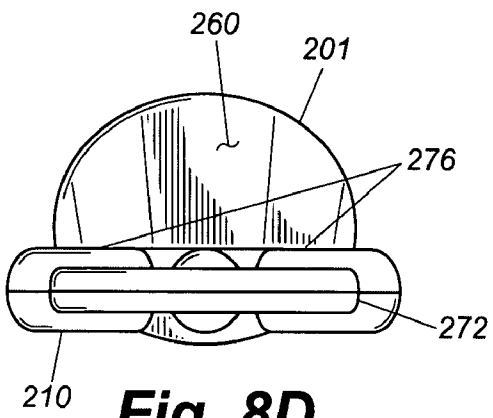
FIG. 8D shows the view from the end having the breakable seal (the front)
Figure 8F:
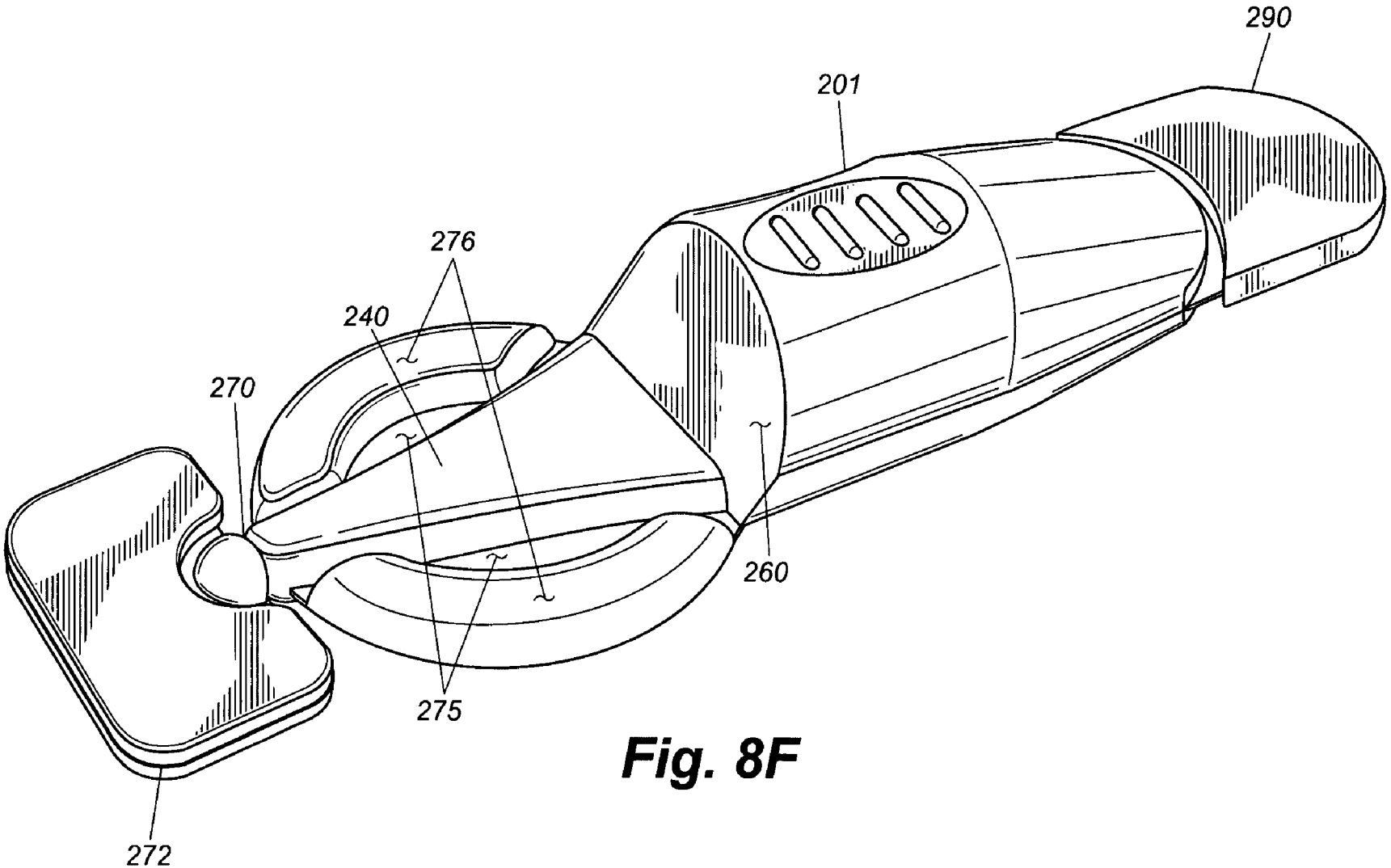
FIG. 8F shows a perspective view of the entire device with a tab attached to the breakable seal.

In the embodiment shown in FIG. 6A, FIG. 6B, and FIG. 8F, the molded contours of the dispensing head result in the formation of flow channels [240]. In the embodiment shown in FIGS. 8A-8F, for example, matching indented portions [275] in either the top or the bottom, or both, define the shape of the passage [240] that interconnects the squeezable reservoir [201] and the outlet Although only one channel is shown in the device of FIGS. 8A-8F, the number, location, shape, size, and diameter of the channels that are formed in the dispensing head by the molding process can be of almost any design. For example, indentations in the dispensing head can be designed to form one channel or multiple channels, and the channels can be regular or irregular in shape, size, diameter, or the like.

In the embodiment shown in FIG. 6A and FIG. 6B, the flow channels are semi-circular and follow the outer perimeter of the dispensing head [210]. In the embodiment shown in FIGS. 8A-8F, the single flow channel [240] is substantially straight from the reservoir to the outlet.

In the embodiment shown in FIGS. 8A through 8F, the matching indented portions [275] define the shape of the passage [240] that interconnects the squeezable reservoir [201] and the outlet, as a single channel interconnecting the squeezable reservoir and the outlet, where the channel [240] is flanked on either side by a curved portion [276] forming a side of the dispensing head. In the embodiment that is illustrated in FIGS. 8A-8F, the single channel passage [240] has a broader width at the end nearer the reservoir [201], and which tapers to a narrower width near the outlet [220]. If desired, and as shown in FIG. 8D and FIG. 8E, each curved portion [276] can have rounded edges in order to increase comfort and safety when the dispensing head is inserted into the mouth of the person to whom the contents of the device are to be administered.

The dispensing head [210] can have any shape. When the shape of the head is discussed, what is meant is the overall outline of the head as viewed from directly above or below the dispensing container [101], excepting where it interconnects with either the reservoir [201] or the breakable seal [270]. For example, the substantially fiat dispensing head is optionally round, oval, square, rectangular, triangular, pentagonal, hexagonal, heptagonal, octagonal, or irregular in shape. It is preferred that the dispensing head [210] is round, oval, oblong, or the like, in order to provide comfortable insertion into the mouth of a user. By way of example, a roughly circular dispensing head [210] is shown in FIG. 1A, and a more oval dispensing head is shown in FIG. 4A.

The dispensing head [210] can be of any thickness suitable for its use. The thickness of the dispensing head [210] is illustrated, for example, as the dimension "t" in FIG. 1B and FIG. 4B. However, it is preferred that the dispensing head is from about 0.5 mm to about 20 mm thick. In some embodiments, the dispensing head may be from about 0.5 mm to about 10 mm thick and sometimes from about 2 mm to about 6 mm thick. In an even more preferred embodiment, the dispensing head may be about 5 mm thick. The actual thickness of the dispensing head will depend on several factors, including the age and mouth size of the subject to which the liquid is being dispensed and various manufacturing tolerances and issues.

A passage [240] interconnects the squeezable reservoir [201] and the outlet [220]. The purpose of the passage [240] is to provide a path whereby the liquid [301] in the reservoir [201] can be delivered to the outlet [220] at the distal end [211] of the dispensing head [210]. The passage can be of any shape or size suitable to deliver the liquid to the outlet. The passage can be split into two or more passages. By way of example, in one embodiment, illustrated in FIG. 4A, FIG. 5A, and in FIG. 6A and FIG. 6B, the passage is split into two semicircular passages each of which follows the outer perimeter of the dispensing head to arrive at the outlet, while in another embodiment, illustrated in FIGS. 8A-8F, the passage is a single channel. An advantage of location of the outlet [220] at the distal end of the dispensing head is that this location insures that the liquid contents of the container are delivered deep into the mouth, or other cavity, of the user, thereby preventing or reducing the rejection or spillage of the liquid as can occur if it is presented in the bowl of a spoon.

The outlet [220] is formed when the breakable seal [270] is broken and removed from its initial position covering the outlet and sealing the container. The outlet can have any shape. For example, the outlet can be oval, rectangular, square, circular, or any other shape. It is preferred, however, that the outlet is substantially circular in shape.

A feature of the present dispensing container is a stop [260], which is disposed near the proximal end [212] of the dispensing head [210]. The stop prevents over-insertion of the dispensing head into a user's mouth. As used herein, the term "over-insertion" means the insertion of a device into the mouth of a user to a depth that causes choking, or blockage of oral air or throat passages. In one embodiment, the stop [260] is located at the proximal end [212] of the dispensing head [210] and extends outwardly from a flat surface of the dispensing head at an acute angle of from about 30° to about 90° from the plane of the dispensing head. In a preferred embodiment, the stop extends outwardly from a flat surface of the dispensing head at an angle of about 60° from the plane of the dispensing head. This is illustrated, for example, in FIG. 1B and FIG. 4B, where the angle "α" denotes the acute angle between the plane of the flat surface of the dispensing head [210] and the stop [260].

The purpose of the stop [260] is to arrest the penetration of the dispensing head into the mouth of the user, therefore it is desirable that the stop be large enough to accomplish this task. Because this feature is particular advantageous when the user is an infant, it is preferred that the stop extends outwardly from a flat surface of the dispensing head a distance sufficient to prevent or retard the continued insertion of the dispensing container into the mouth of an infant past the stop.

In one embodiment of the present dispensing container [101], the stop is a portion of the outer surface of the reservoir [201]. This is illustrated, for example, in FIG. 1A, FIG. 1B, FIG. 1C and FIG. 4A, FIG. 4B and FIG. 4C, where the stop [260] is shown as the outside surface of the front wall of the squeezable reservoir [201]. If desirable, the front wall of the reservoir can be made to be slightly thicker than other walls of the reservoir in order to retain its shape and function during use.

The present dispensing container [101] can also be made to have a tail [290]. The tail can be of any shape, but is typically substantially flat and is disposed from the reservoir [201] at a location that is opposite the dispensing head [210] and in a plane that is substantially parallel to the plane of the dispensing head. This position of the tail [290] is illustrated, for example, in FIG. 1A, FIG. 1B and FIG. 4A and FIG. 4B, as well as in FIG. 7A-7E. A useful feature of the tail is that it increases the gripping surface of the dispensing container, and, optionally, it can be used to display information relating to some characteristic of the dispensing container or its contents. By way of example, such information can include the volume of the liquid contained in the reservoir, the date of manufacture of the liquid, the date of filing the container, the date of recommended use for the liquid, the expiration date for the liquid, the chemical name of the liquid, the catalog or lot number of the liquid, or the common name of the liquid, or the like.

Also within the scope of the present invention is a pre-filled dispensing container having a liquid therein. The container comprises a squeezable reservoir that contains the liquid; a substantially flat dispensing head which is integral with the squeezable reservoir and having a distal end and a proximal end; an outlet at the distal end of the dispensing head for dispensing the liquid from the container; a passage interconnecting the squeezable reservoir and the outlet; and a stop disposed near the proximal end of the dispensing head to prevent over-insertion of the dispensing head into a user's mouth when the container is used to dispense liquid to the user.

FIGS. 2A and 2B, and FIGS. 5A and 5B illustrate several features of an embodiment of a pre-filled dispensing container. For example, these figures illustrate the dispensing container [101] having a liquid [301] in the squeezable reservoir [201].

The present device can be used to contain and dispense almost any liquid that is suitable for administration to a user. As the term "liquid", is used herein, it should be understood to include a clear liquid, a paste, suspension, emulsion, microemulsion, or any other material having the general flow characteristics of a liquid. It is preferred that the viscosity of the liquid is from about 0.05 to about 1,000,000 centipoise at room temperature. Viscosities may also range from about 0.5 to about 20,000 centipoise and from about 1.0 to about 10,000 centipoise, with a viscosity of from about 1.0 to about 1,000 centipoise being even more preferable.

The present dispensing container is useful for administering a liquid to a user. In particular, it is useful for delivering a measured amount of a liquid to the user. As mentioned above, this characteristic is desirable when administering liquids to users where the amount of the liquid that is delivered to the user is important, such as, for example, the administration of drugs, neutraceuticals, vitamins, or medicines. In a preferred embodiment, the liquid [301] is selected from vitamins, over-the-counter drugs, or prescription drugs.

Figure 2A:
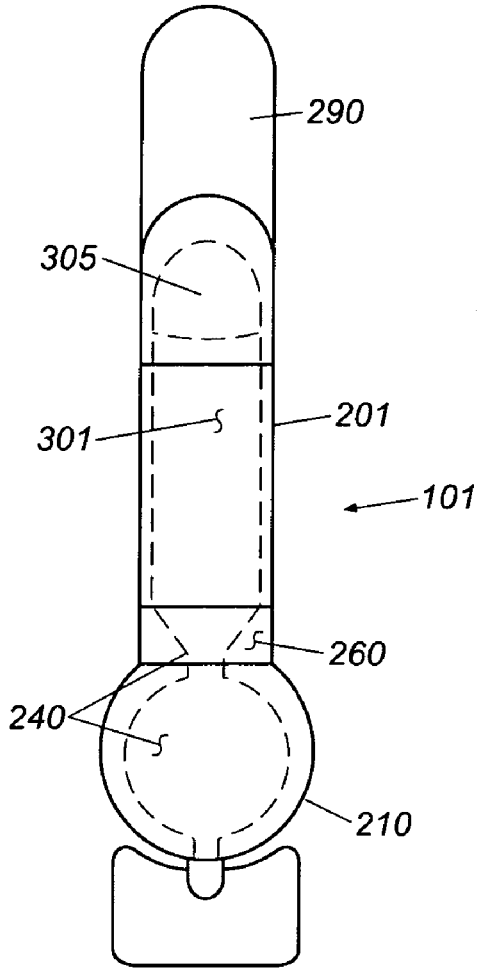
FIG. 2A shows the top view (without the optional traction aid) and FIG. 2B shows a side view, with both views illustrating the reservoir holding liquid and with a head-space above the liquid level.
Figure 2B:
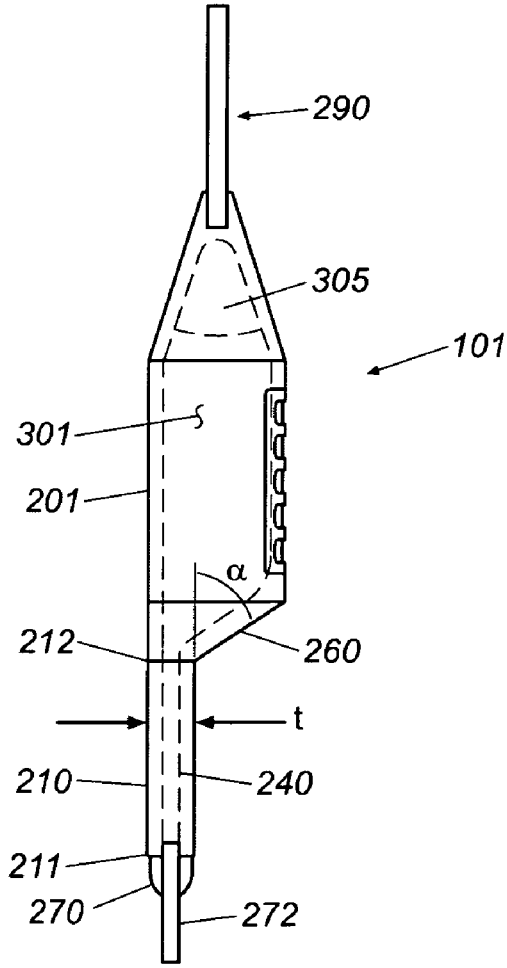

When the liquid [301] is added to the squeezable reservoir [201] of the present device, it is sometimes desirable, although not required, that the reservoir also contain a gas in the head-space of the reservoir. In some embodiments, it is desirable to control the type of gas that is added, such as, for example, when it is desirable to have an inert gas in the head-space. This can be done by controlling the type of gas that is added to the head-space, and/or the pressure of the head-space gas. In FIG. 2A and FIG. 2B, the head-space gas is illustrated as [305].

Although the head-space gas [305], if one is used, can be almost any gas, it is preferred that the head-space gas comprises air, sterile air, oxygen gas, nitrogen gas, other inert gas, or a mixture thereof. In like manner, although the head-space gas can be included in the reservoir at almost any pressure which the reservoir will withstand, it is preferred that the head-space gas in the reservoir is at a pressure of from 0 to about 3 bar gauge, with a pressure of from about 0 to about 1 bar gauge being more preferred. In some embodiments, a vacuum may be present in the head-space so that the pressure is actually less than 0 bar gauge. However, most embodiments of the present invention will have atmospheric pressure (e.g., 0 bar gauge) in any head-space. The exact pressure employed may vary depending on the viscosity of the liquid being used.

The present dispensing container can be made by any method. However, it has been found that a preferred method for manufacturing the device is by blow-fill-seal technology. Information about blow-fill-seal technology can be found, for example, in *Blow-Fill-Seal Technology*, R. Oschmann et al., CRC Press, Boca Raton, Fla. (1999), or in *Blow-Fill-Seal—Advanced Aseptic Processing*, D. Jones, published in *Encyclopedia of Pharmaceutical Technology,* $2^{nd}$ Ed., Marcel Dekker, Inc., New York, N.Y. (2002). Blow-fill-seal systems and equipment are available from several manufacturers, such as rommelag® USA, Inc., Edison, N.J.

The present invention is also directed to a novel method of making a pre-filled dispensing container having a liquid therein, the method comprising: extruding a polymer into a blow mold; closing the mold; forming a dispensing container comprising a squeezable reservoir designed to contain the liquid, a substantially flat dispensing head which is integral with the squeezable reservoir and having a distal end and a proximal end, an outlet at the distal end of the dispensing head for dispensing liquid from the container, a passage interconnecting the squeezable reservoir and the outlet, and a stop disposed near the proximal end of the dispensing head to prevent over-insertion of the dispensing head into a user's mouth when the container is used to dispense liquid to the user; adding the liquid to the dispensing container; sealing the outlet with a breakable seal; and removing the sealed pre-filled dispensing container from the mold.

Almost any thermoplastic or thermoset polymer can be used for the production of the present dispensing container. However, it is preferred that the polymer is one that can be extruded. Examples of polymers that are useful for the production of the present invention include, without limitation, polyethylene, polypropylene, ethyl vinyl alcohol copolymer, cyclic olefin copolymer, cyclic olefin polymer, liquid crystal polymer, polyethylene terephthalate, anhydride modified polyolefin, polycarbonate, polyacrylic, polyacrylonitrile, polyvinylchloride, polystyrene, a fluoropolymer, a thermoplastic polyester, nylon, or a mixture of any of these.

Examples of polymers that are preferred for use in the present device include low-density polyethylene, high-density polyethylene, linear low density polyethylene, medium density polyethylene, oriented polyethylene terephthalate, polyethylene terephthalate copolymer, anhydride modified ethylene vinyl acetate, anhydride modified low density polyethylene, anhydride modified linear low density polyethylene, polybutylene terephthalate, crystalline nylon, amorphous nylon, MXD6, or mixtures thereof. It is more preferred that the polymer from which the present device is made is low-density polyethylene, high-density polyethylene, medium density polyethylene, or polypropylene.

Polymers that are useful for the production of the present container can also be intermixed with any type of additive that is typically used in polymer processing and which does not interact undesirably with the liquid. Additives such as: UV stabilizers, thermal stabilizers, processing aids, nucleating agents, clarifiers, and antistatic agents may be added to the resins above during the production of the container at any percent loading.

Polymers that are useful for the production of the present device can be characterized by their melt index. As used herein, the terms "melt index" mean the number of grams of a polymer that can be forced through a 0.0825 inch orifice in 10 minutes at 190° C. by a pressure exerted by a mass of 2160 g (43.25 psi). In preferred embodiments, the polymer has a melt index between about 0.1 and 200 g/10 min and more preferred is a polymer having a melt index between about 0.1 to about 20 g/10 min. The melt index will depend on the particular polymer chosen in order to provide the container with the desired characteristics for its operating environment to allow successful transfer of any liquid contained therein.

In some embodiments of the present dispensing container, it is preferred that the polymer is sufficiently transparent or translucent that the amount or condition of liquid in the reservoir can be determined visually. This is particularly useful to determine whether the full amount of the contents of the reservoir have been expelled when the device is used. Also, this feature is useful when the visible features of the liquid indicate some characteristic, such as, for example, when cloudiness of the liquid could indicate contamination, or excess aging, or the like. In other embodiments, it may be advantageous for the reservoir to be shielded from light, such as, for example, when the liquid contents include a light-sensitive material. In these embodiments, light shielding can be provided by the use of an opaque polymer, a polymer filled with a light-shielding material, or the like.

In some embodiments of the pre-filled dispensing container, the dispensing container can be color-coded to identify a property of the liquid in the reservoir. This is particularly useful when it is desirable to provide a clear and easily understood signal of some characteristic of the device or its contents. For example, a red container could signify contents requiring particular care in use, or the like. A blue container could indicate liquid contents requiring refrigeration, or the like.

In a preferred method, the polymer is extruded into the blow mold in the form of a parison. As used herein, the term "parison" means an extruded tube of plastic or polymer. Further preferred, is a method wherein the dispensing container is formed from a single piece of polymer. However, the parison is optionally formed from a single polymer, a blend of two or more polymers, or a multilayer structure comprising two or more layers of the same or different polymers. The polymeric materials may be used as a single layer in a monolayer structure for the present device, or as a layer in a multi-layer structure. The multi-layer structure may be manufactured using co-extrusion. The multi-layer structure may consist of any combination of polymers listed above and in any order and any frequency.

The step of forming a dispensing container can be accomplished by applying the mold around or onto the parison and applying a vacuum to the mold surface followed by the application of compressed gas or vacuum to the mold. In an embodiment of the present method, the step of closing the mold can form the breakable seal [270] and integral tab [272] to seal the outlet [220] of the container. Alternatively, the step of closing the mold can seal one end of the reservoir by forming the tail [290] of the dispensing container. The operation of a blow-fill-seal system to form aseptic packages is well known in the art.

One feature of the present method is the control of the thickness of the walls of the squeezable reservoir. This parameter, along with the characteristics of the polymer that is used, controls the degree of pressure that is required to collapse the walls of the reservoir and express the liquid [301] from the outlet [220] of the device, after the breakable seal is removed. In one embodiment, the thickness of the wall of the squeezable reservoir is from about 0.01 mm to about 5 mm, preferably from about 0.01 mm to about 3 mm, and more preferably from about 0.05 to about 1 mm.

The polymer is typically extruded from the outlet of an extruder at a temperature that is above its glass transition temperature and in the form of a parison. The polymer then enters the blow mold at or very near this temperature. It is preferred that the temperature of the polymer entering the blow mold is between about 50° C. and about 1000° C., more preferred is a temperature of between about 100° C. and about 500° C., and even more preferred is a temperature between about 100° C. and about 300° C. The exact temperature of the polymer entering the blow mold depends on the polymer chosen and the operating conditions and parameters of the molding and filling process, As discussed above, the present method can also include the step of adding a head-space gas to the reservoir. Although the gas can be added at any temperature, it is preferred that the head-space gas is added to the reservoir at a temperature of between about 10° C. and 500° C., preferably between about 100° C. and about 500° C., and even more preferably between about 100° C. and about 300° C.

When the liquid is added to the reservoir, it can be added at any temperature at which it is stable, but often the liquid is added to the dispensing container at a temperature of from about 2° C. to about 65° C., and preferably from about 10° C. to about 50° C., and most preferably from about 15° C. to about 25° C.

The process may be carried out so that a sterile product is formed. For example, depending upon the sterility requirements of the liquid, the sterility of the liquid and gas in the reservoir can be closely controlled to yield a sterile charge in the reservoir.

When gas and/or liquid has been added to the reservoir, the dispensing container can be sealed by the action of an additional die that closes to seal the container. Preferably this step can be used to form a substantially flat tail [290] that is disposed from the reservoir opposite the dispensing head and in a plane that is substantially parallel to the plane of the dispensing head.

The molded, filled and sealed dispensing container is allowed to cool in the mold sufficiently to retain its shape, and then the mold is opened and the device is removed. Any desirable printing, labeling, or other information that is to be added to the device is then applied. When the device is ready for use, it can be packaged for storage, shipment, sale and use.

The present dispensing container is easily used by breaking the breakable seal and removing the removable part of the seal and the tab and inserting the dispensing head into the mouth, or other orifice, of the user into which the contents of the device are to be deposited, and using the fingers, or thumb and fingers, to squeeze the squeezable reservoir and express the liquid contents from the outlet.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions by those of ordinary skill in the art without departing from the scope of the invention, it is intended that all matter contained in the above description and shown in the accompanying drawings shall be interpreted as illustrative and not in a limiting sense. In addition it should be understood that aspects of the various embodiments may be interchanged both in whole or in part.

What is claimed is:

1. A dispensing container fillable with a liquid, the container comprising:

a squeezable reservoir for holding the liquid prior to dispensing;

a dispensing head which is substantially flat in profile and which is integral with the squeezable reservoir and having a distal end and a proximal end and having a bottom surface and a top surface one or both of which has an indented portion;

an outlet at the distal end of the dispensing head for dispensing the liquid from the container;

a passage interconnecting the squeezable reservoir and the outlet wherein the indented portion defines the shape of the passage; and a stop disposed near the proximal end and extending outwardly from a flat surface of the dispensing head a distance sufficient to prevent over-insertion of the dispensing head into a user's mouth past the stop when the container is used to dispense the liquid to the user, wherein the stop is a portion of an outer wall of the squeezable reservoir that is thicker than the other walls of the reservoir in order to retain its shape and function during use.

2. The dispensing container according to claim 1, wherein the top surface of the dispensing head has an indented portion.

3. The dispensing container according to claim 1, wherein the bottom surface of the dispensing head has an indented portion.

4. The dispensing container according to claim 1, wherein the top surface and the bottom surface of the dispensing head have matching indented portions.

5. The dispensing container according to claim 4, wherein the matching indented portions define the shape of the passage that interconnects the squeezable reservoir and the outlet.

6. The dispensing container according to claim 5, wherein the passage comprises a single channel interconnecting the squeezable reservoir and the outlet.

7. The dispensing container according to claim 5, wherein the matching indented portions define the shape of the passage that interconnects the squeezable reservoir and the outlet as a single channel interconnecting the squeezable reservoir and the outlet, where the channel is flanked on either side by a curved portion forming a side of the dispensing head and having rounded edges.

8. The dispensing container according to claim 1, wherein the dispensing container is unitary.

9. The dispensing container according to claim 1, wherein the squeezable reservoir has an outer surface having a traction aid thereon, whereby the traction aids improve the grip of the container by the user.

10. The dispensing container according to claim 9, wherein the traction aid comprises at least one of ribs, grooves, a roughened area, or a checkered area.

11. The dispensing container according to claim 1, wherein the dispensing head is optionally round, oval, square, rectangular, triangular, pentagonal, hexagonal, heptagonal, octagonal, or irregular in shape.

12. The dispensing container according to claim 1, wherein the outlet is closed by a breakable seal which reveals the outlet when the seal is broken.

13. The dispensing container according to claim 12, wherein the breakable seal is integral with a tab which is designed for gripping between the thumb and forefinger for the purpose of breaking the seal.

14. The dispensing container according to claim 1, wherein the stop is located at the proximal end of the dispensing head and extends outwardly from a flat surface of the dispensing head at an angle of from about 30° to about 90° from the plane of the dispensing head.

15. The dispensing container according to claim 13, wherein the stop extends outwardly from a flat surface of the dispensing head a distance sufficient to prevent or retard the continued insertion of the dispensing container into the mouth of an infant past the stop.

16. The dispensing container according to claim 1, further comprising a substantially flat tail disposed from the reservoir opposite the dispensing head and in a plane that is substantially parallel to the plane of the dispensing head.

17. A pre-filled dispensing container having a liquid therein, the container comprising:

a squeezable reservoir containing the liquid;

a dispensing head which is substantially flat in profile and which is integral with the squeezable reservoir and having a distal end and a proximal end and having a bottom surface and a top surface one or both of which has an indented portion;

an outlet at the distal end of the dispensing head for dispensing the liquid from the container;

a passage interconnecting the squeezable reservoir and the outlet wherein the indented portion defines the shape of the passage; and a stop disposed near the proximal end and extending outwardly from a flat surface of the dispensing head a distance sufficient to prevent over-insertion of the dispensing head into a user's mouth past the stop when the container is used to dispense liquid to the user, wherein the stop is a portion of an outer wall of the squeezable reservoir that is thicker than the other walls of the reservoir in order to retain its shape and function during use.

18. The pre-filled dispensing container according to claim 17, wherein the liquid comprises at least one material that is selected from vitamins, over-the-counter drugs, or prescription drugs.

19. The pre-filled dispensing container according to claim 17, wherein the pre-filled dispensing container is formed from a polymer which is sufficiently transparent or translucent that the amount of liquid in the reservoir can be determined visually.

20. The pre-filled dispensing container according to claim 17, wherein the dispensing container is color-coded to identify a property of the liquid in the reservoir.

21. The pre-filled dispensing container according to claim 17, wherein the dispensing container is formed from a single piece of polymer.

* * * * *